US007396176B2

(12) United States Patent
Schoemer

(10) Patent No.: US 7,396,176 B2
(45) Date of Patent: Jul. 8, 2008

(54) CORN ON THE COB BUTTERING DEVICE

(76) Inventor: Karl G. Schoemer, 39 Timber La., Brownsburg, IN (US) 46112

( * ) Notice: Subject to any disclaimer, the term of this patent is extended or adjusted under 35 U.S.C. 154(b) by 62 days.

(21) Appl. No.: 11/480,655

(22) Filed: Jul. 1, 2006

(65) Prior Publication Data

US 2007/0003357 A1 Jan. 4, 2007

Related U.S. Application Data

(60) Provisional application No. 60/696,344, filed on Jul. 1, 2005.

(51) Int. Cl.
*A46B 11/00* (2006.01)
*A23G 3/24* (2006.01)
*A47J 27/00* (2006.01)

(52) U.S. Cl. ..... 401/12; 401/9; 220/573.4; 118/26; 118/29

(58) Field of Classification Search ..... 401/1, 401/2, 12, 122; 118/26, 27, 29, 30; 99/410–414, 99/403, 416, 417, 449; 220/254, 573.4, 573.5
See application file for complete search history.

(56) References Cited

U.S. PATENT DOCUMENTS 3,038,402 A * 6/1962 Singer ..... 99/403
3,308,269 A 3/1967 Stocker
3,605,684 A 9/1971 McGinley
4,301,762 A 11/1981 Burnett, Jr.
4,676,186 A 6/1987 Draines
D378,041 S 2/1997 Stoval
5,858,089 A 1/1999 Nmartinovic
6,290,412 B1 9/2001 Birmingham
6,299,368 B1 10/2001 Tavularis
6,572,296 B2 * 6/2003 Schrepf ..... 401/122
6,616,363 B1 * 9/2003 Guillaume et al. ..... 401/1

* cited by examiner

*Primary Examiner*—David J Walczak
(74) *Attorney, Agent, or Firm*—Paul M. Denk

(57) ABSTRACT

The buttering device is a double walled vessel having an interior chamber containing liquid butter, a lid, and a handle. The vessel has a height sufficient to admit a corn on the cob and between the outer wall and the inner wall, an hollow annular space for heated water. The lid closes the top of the chamber and extends over the outer wall of the vessel. The lid has a center opening with flaps that admits the end of corn on the cob and the flaps glide upon the corn. Heated water placed in the annular space melts butter added to the chamber. Corn on the cob, inserted through the opening, coats itself in butter. Once buttered, the corn on the cob is withdrawn from the lid where the flaps retain excess butter within the chamber.

10 Claims, 4 Drawing Sheets

CORN ON THE COB BUTTERING DEVICE

CROSS REFERENCE TO RELATED APPLICATION

This nonprovisional patent application claims priority to the provisional patent application having Ser. No. 60/696,344, filed on Jul. 1, 2005.

BACKGROUND OF THE INVENTION

This corn on the cob buttering device relates to condiment dispensers for food and more specifically to a vessel for coating liquid butter upon corn on the cob. A unique aspect of the buttering device is a lid with flaps for removing excess butter from the cob, and for conveniently keeping the butter melted.

Since the time of the Pilgrims, people have enjoyed corn in many varieties. As a food, corn provides fiber and a few vitamins and minerals. Corn also provides a convenient handle or stump for holding when still on the cob. Unshucked or shucked, corn on the cob can be cooked in various ways and seasoned to taste. Most often, corn on the cob is boiled and then seasoned with salt and plenty of butter. People definitely enjoy buttered corn on the cob.

Corn on the cob is served at home, at picnics, at fairs, and at a host of other places and events. In most places, people individually butter their corn. Butter is applied to the corn by a pad sliced from a stick of butter and held by a knife and the cob is turned beneath. The cob is also placed upon a stick of butter lengthwise and then rotated to pick up butter evenly. Many devices have come and gone to apply butter to corn on the cob.

For other condiments, tanks with plungers dispense a condiment upon food or into a cup. Commonly at large sporting venues, meat foods are sold and consumers apply mustard, ketchup, and the like upon their hot dogs by pressing down a plunger while holding the hot dog beneath. The bun assists in keeping the condiment upon the hot dog. However, butter applied onto corn on the cob from a plunger tends to run off the round shape of the cob.

The present art overcomes the limitations of the prior art. That is, in the art of the present invention, liquid butter is placed and maintained in a vessel and corn on the cob is inserted into the vessel lengthwise to pick up butter.

DESCRIPTION OF THE PRIOR ART

The difficulty in providing a corn on the cob buttering device is shown by the operation of a typical corn butterer. A common butterer has an outer case, hollow and square shaped and sized to admit part of a stick of butter, and a plunger that fits within the case behind the stick of butter. The outer case has a curved opening that exudes the butter when advanced by the plunger. The curved opening is dragged upon the corn on the cob as the cob is turned and the butter advanced. The common butterer works in home use where sanitation can be controlled. In public use at a state fair or an art fair for instance, the common butterer on a condiment stand leaves butter exposed to the elements, insects, and other disease vectors.

Other buttering devices seek to butter corn on the cob rapidly with a minimum of mess and maximum of sanitation. The patent to Stocker, U.S. Pat. No. 3,308,269, shows a corn-on-the-cob butterer. This is simply a tray, which may have a tapered bottom, or the pivotal supports for the stem holding devices can be inclined for holding a supply of butter therein, and to pivot the corn cob for its buttering. A heating wire is circuitously located within the floor of the device.

The patent to McGinley, U.S. Pat. No. 3,605,684, shows a motor-driven butter roll used for buttering rolls and bread. It simply incorporates a pan having a journaled roller assembly which descends down into the pan, to pick up butter, and where a roll may be pressed against it for coating the surface of the roll with melted butter. The heat from the motor maintains the butter as liquid. Apparently the bracket members are intended to function as heat transfer devices.

The patent to Burnett, Jr., U.S. Pat. No. 4,301,762, is upon a corn buttering device that includes a support pan which contains the hot water or liquid. Then, an arcuate recess is located in the upper region, and which is spring biased upwardly. A butter receptacle then submerges partially within the heated water and communicates butter through the butter receptacle opening for applying butter onto the cob located within the recess. Then, it includes a condiment dispenser such as for salt, that can be bent over and rubbed against the ear of corn.

The patent to Drainas, U.S. Pat. No. 4,676,186, shows another butter rolling device that includes a reservoir, having a drum. The drum partially submerges within the contained liquid butter, so that when the drum is turned, a coating of butter is exposed upwardly, apparently for application to the surface of items such as bread, toast, rolls, or the like.

The patent to Stovall, No. Des. 378,041, is a design patent upon a hot butter bottle. In principle, this is related to the present invention but in appearance, the present invention is quite distinct. The present invention does not include the specific shape of this bottle, and includes a different style of lid and a handle.

The patent to Martinovic, U.S. Pat. No. 5,858,089, shows a corn buttering tool. This is just another horizontally disposed butter bin, where a stick of butter locates therein, and then has a stainless steel mesh screen that locates thereover. Upon the heated screen, the corn cob is rolled and can cause the butter's surface to melt and permeate through the screen for buttering of the corn.

The patent to Birmingham, U.S. Pat. No. 6,290,412, is upon a butter melter and applicator. This particular device includes a container, with a removable lid, and a lid fork that removably inserts within the distal end of the corn cob, such that the fork can be rotated thus, coating the cob with butter. The device does not describe how the butter is melted or kept liquid. During usage, the applicator must be turned on its side, to apply melted butter to the corn cob.

Finally, the patent to Tavularis, U.S. Pat. No. 6,299,368, is upon another corn buttering device that includes a cylindrical container slightly larger than the ear of corn, a supply of melted butter in its lower half, and a lid. When an ear of corn is placed therein, the displaced butter rises within the container, and coats it. The wiping means incorporates bristles that brush off excess butter from the ear, so that it does not drip too much. These patent claims define that the wiping means incorporates a plurality of bristles and said wiping means is positioned on an interior surface of the side wall of the container.

The present invention overcomes the difficulties of the prior art. The present invention has an upright vessel containing liquid butter and a lid that admits one corn on the cob lengthwise into the vessel then nearly closes the opening to the vessel upon withdrawal of the corn on the cob.

SUMMARY OF THE INVENTION

The buttering device is a double walled vessel having an interior chamber containing liquid butter, a lid upon the opening to the chamber, and a handle upon the vessel. The double walled vessel has a generally cylindrical shape, a height sufficient to admit a corn on the cob, a bottom closed by the outer wall, a chamber formed by the inner wall, and an open top of the chamber. Between the outer wall and the inner wall, the vessel has a hollow annular space into which heated or hot water can be introduced. A round lid closes the top of the chamber and extends over the outer wall of the vessel. The lid has a center opening with flaps that admits the end of corn on the cob and the flaps pass along the corn. The handle joins in a pivotal connection to the outer wall proximate to the lid.

To use the present invention, hot water is placed in the annular space and butter added to the chamber. Sufficient butter is provided to fill the chamber and the hot water liquefies the butter. Corn on the cob is then inserted through the opening in the lid and into the butter. Once the cob up to the start of the stump is inserted through the opening, the corn on the cob is withdrawn from the lid. In withdrawing the cob, the flaps retain excess butter within the chamber thus preventing drips and other messes from the buttered corn on the cob.

BRIEF DESCRIPTION OF THE DRAWINGS

The same reference numerals refer to the same parts throughout the various figures.

DESCRIPTION OF THE PREFERRED EMBODIMENT

Figure 1:
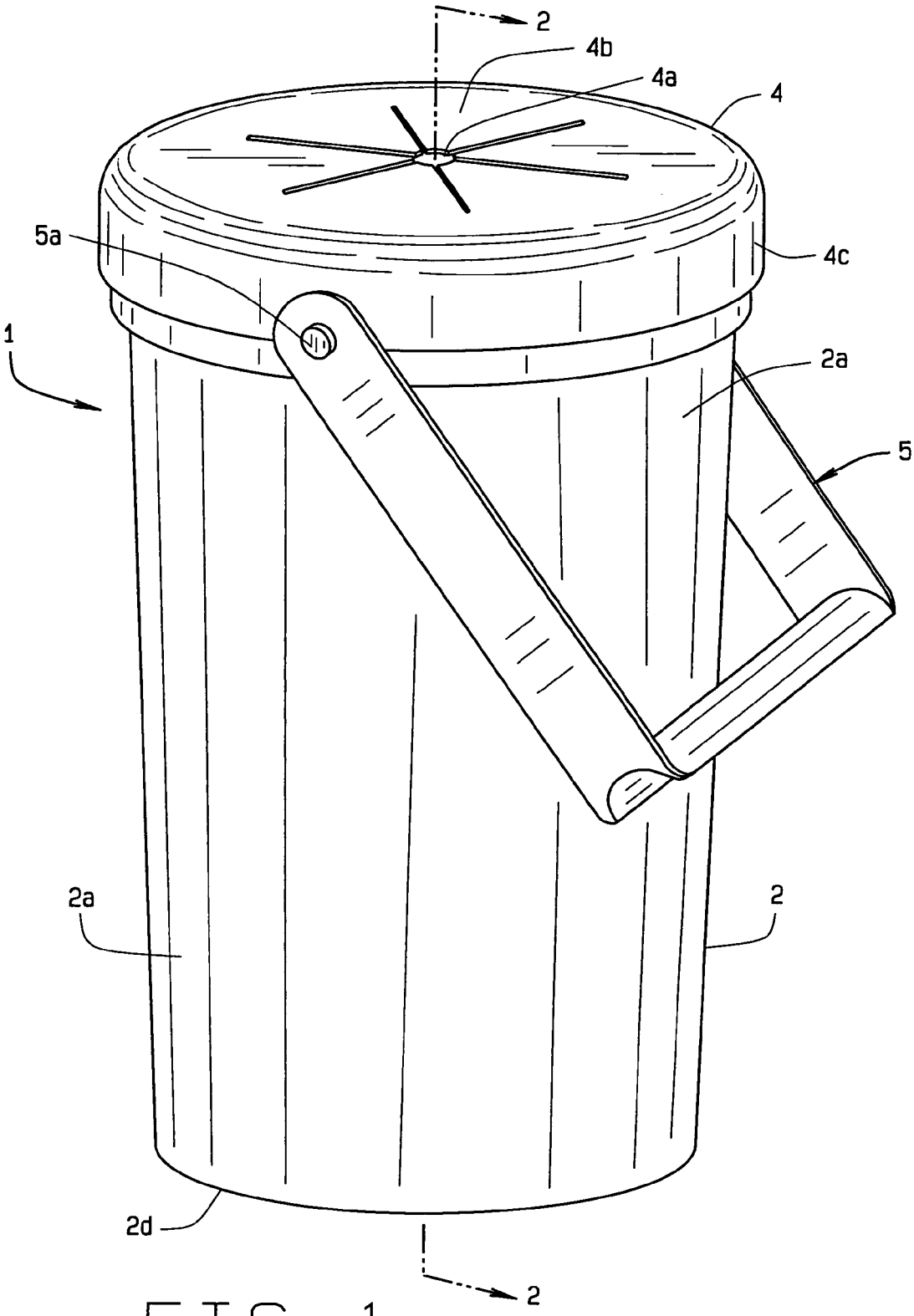
FIG. 1 shows a side view of the preferred embodiment of the present invention.

The present art overcomes the prior art limitations by providing a buttering device for corn on the cob that allows dipping the cob lengthwise into a container holding melted butter. Turning to FIG. 1, the present invention 1 appears as a cylindrical vessel 2 having a bottom 2*d* and an outer wall 2*a* contiguous with the perimeter of the bottom 2*d*. Opposite the bottom, the vessel has an open top here shown covered by a lid 4. The lid 4 has a generally round shape of a diameter to span the top of the vessel. The lid extends over the top and partially down the outer wall with a band 4*c*.

More particularly, the vessel 2 has a pair of pins 5*a* extending outward from the outer wall 2*a*. The pins 5*a* are opposite each other, round, and coaxial. A handle 5 connects to the pins and swivels upon the pins when the present invention is moved. The handle 5 has a generally U shape with a grip opposite the connection of the handle to the pins. The lid has a bayonet type lock that secures to the pins 5*a*. Above the pins, the lid 4 has a centered opening 4*a* of sufficient diameter to snugly admit a cob of corn. The opening 4*a* is centered between three or more flaps 4*b*. FIG. 1 shows six flaps. The flaps 4*b* are separated by slits 4*e* into the lid 4. The flaps generally have two free edges and a fixed edge 4*d* that connects a flap to the lid.

Figure 2:
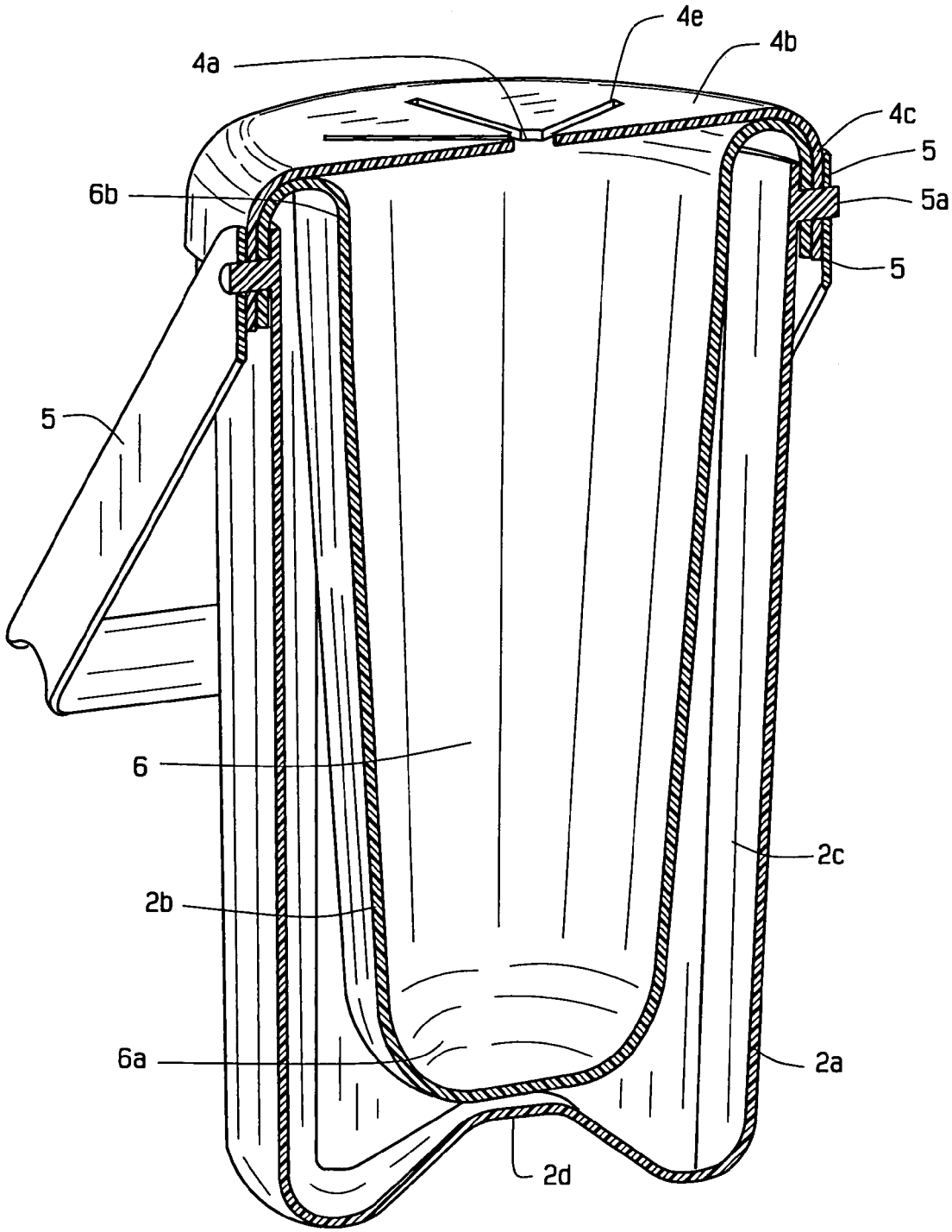
FIG. 2 shows a sectional view of the present invention.

The construction of the present invention is shown in FIG. 2. Within the outer wall, the vessel 2 has an annular space 2*c* and then an inner wall 2*b* forming a chamber 6. Or, the inner wall may be tapered into a conical shape. The chamber 6 has a generally cylindrical shape that ends above the bottom. The raised bottom permits circulation of water beneath the bottom of the chamber. The chamber has a solid bottom 6*a* and opposite the bottom, the chamber has the inner wall 6*b* extended, forming an open top, and then turned down and outward over the outer wall 2*a* proximate to the handle 5 and the band 4*c*. The inner wall has a bayonet type of lock that secures the inner wall 6*b* to the pins. The pins 5*a* extend out from the outer wall opposite the bottom. In this embodiment, the bottom 2*d* is raised upward towards the inner wall 2*b* and permits circulation of water beneath the bottom of the chamber.

Upon the top of the inner wall, the lid 4 spans the chamber then turns down and outward over the inner wall as the band 4*c*. The band has two opposite holes that admit the pins and secure the lid upon the vessel. Here shown in sectional view, the lid has flaps 4*b* of a generally planar shape that end at an opening 4*a*. The flaps readily bend in the direction of movement of an inserted cob of corn. Bending down towards the vessel, the flaps admit one cob and then bending out from the vessel, the flaps glide upon the cob and remove excess butter. Each flap is separated from adjacent flaps by slits 4*e*, here shown incised.

Figure 3:
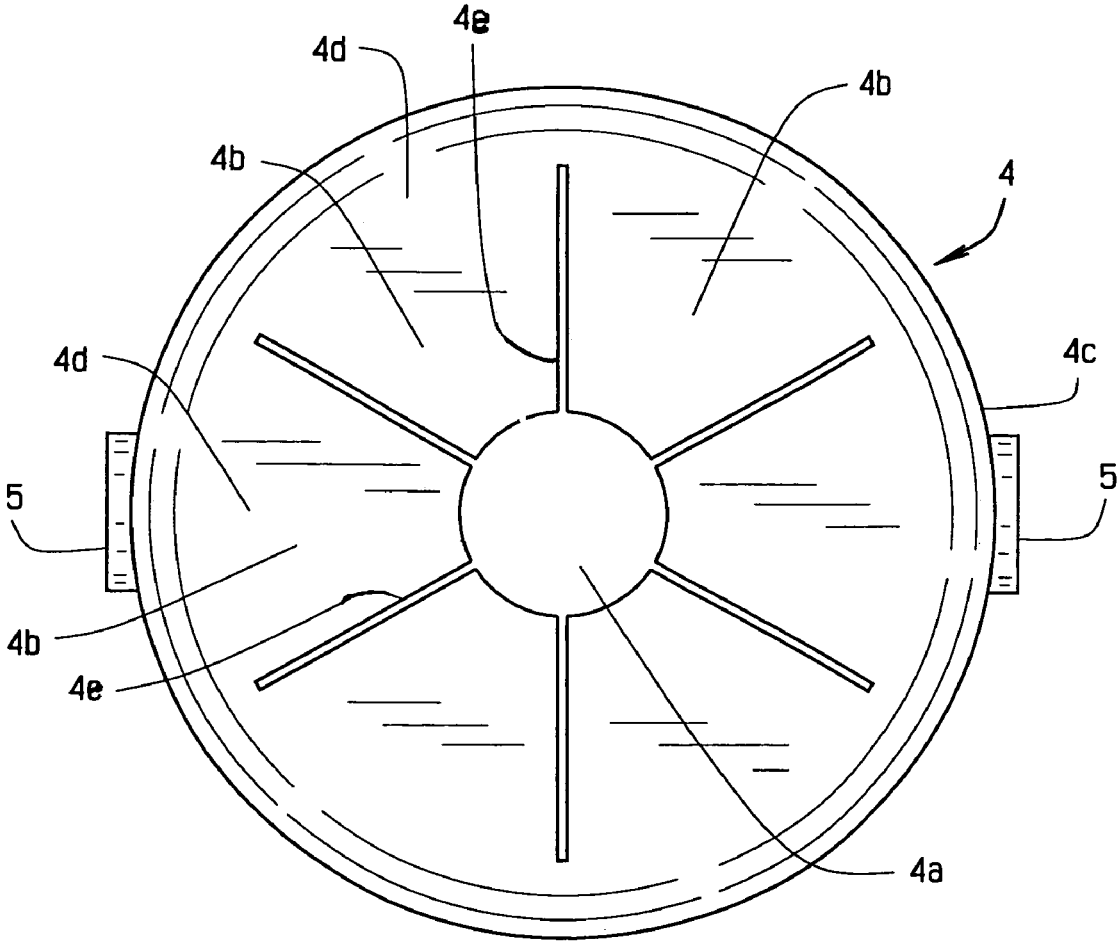
FIG. 3 describes a top view of the present invention, particularly of the lid.

FIG. 3 shows the vessel from above the lid 4. Upon opposite sides of the outer wall, the handle 5 attaches to the pins. The band 4*c* extends upward from the handles around the perimeter of the vessel 2, generally upon the outer wall 2*a*. The band turns over and forms the body of the lid 4. The lid has a generally planar shape here shown as round. The lid has three or more flaps 4*b* that extend from the band 4*c* towards the centered opening 4*a*. The opening 4*a* has a diameter to snugly admit corn on the cob. The flaps are separated by slits 4*e*. The slits flank a flap and are generally mutually oriented to the center of the opening. Between the slits towards the narrow part of the flap, the flap has a leading edge 4*c*. The leading edge glides upon the corn as the cob is inserted and withdrawn through the opening. Opposite the leading edge, each flap has the bending area 4*d*. The bending area 4*d* extends from the ends of the slits 4*e* flanking a flap opposite the opening. The lid has material of sufficient durability to withstand tens of thousands of deflections of the flaps as cobs are buttered by the invention. FIG. 3 shows six flaps for even coverage around a cob. However, a minimum of two flaps can surround a cob and still remove excess butter from cobs of varying diameter.

Figure 4:
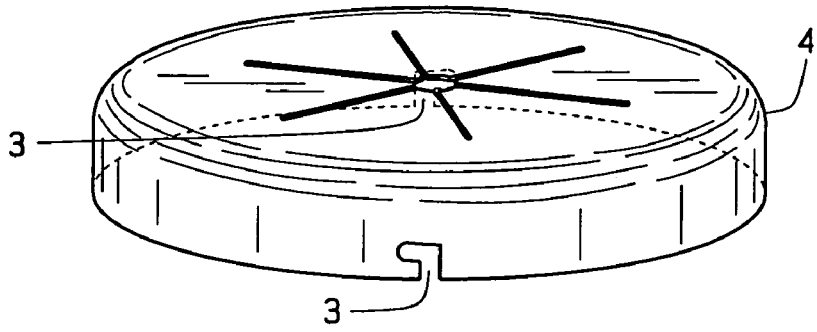
FIG. 4 shows the lid of the present invention with a bayonet type lock; and, FIG. 5 describes the inner wall of the present invention with a bayonet type lock.
Figure 5:
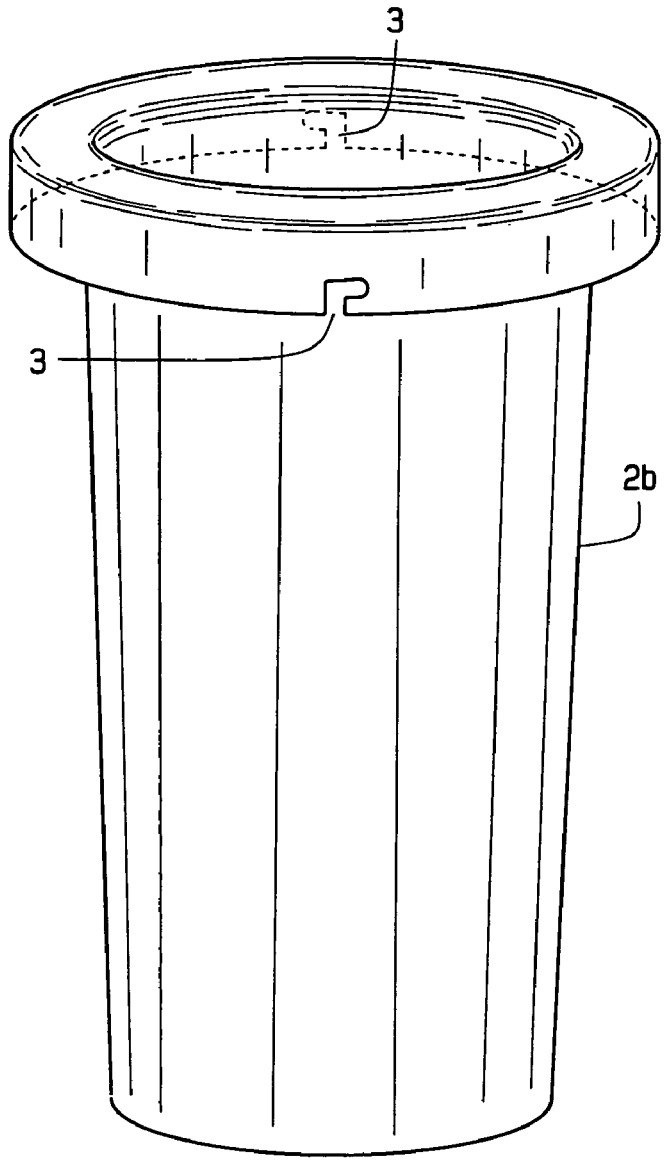

As previously shown in FIG. 2, the lid 4 and the inner wall 2*b* removably secure to the pins 5. The lid and the inner wall have bayonet type locks in the preferred embodiment. Each bayonet type lock 3 has an inverted L shape as shown in FIG. 4 for the lid and FIG. 5 for the inner wall. The bayonet locks 3 are located opposite one another upon a diameter of the lid 4 and the inner wall 2*b* respectively. The bayonet locks 3 have sufficient width to admit the pins 5. First the inner wall and then the lid are placed upon the pins to close the vessel. The inner wall and then the lid are oriented with the upright portion of the bayonet lock 3 at the pins 5. The inner wall and then the lid are lowered upon the pins 5 until the pins enter the horizontal portion of the locks 3. The inner wall is first rotated clockwise to seat the inner wall upon the pins 5 within the lock 3. Then the lid is rotated counter-clockwise to seat the lid upon the inner wall and the lid, particularly the band, upon the pins 5. The lid 4 and the inner wall 2*b* have bayonet locks 3 in opposite directions to prevent accidental disassembly of the invention, which is more likely with locks 3 oriented in the same direction.

In use at a picnic, fair or the like, a person rotates the lid and then the inner wall to detach them from the pins. The person then adds hot or heated water into the vessel inside of the outer wall. A person seats and then rotates the inner wall onto the pins at the locks and then adds butter to the chamber. In an alternate embodiment, a person adds hot water by opening the lid.

Sufficient butter is provided to fill the chamber at least for half of the height of the vessel and the hot or heated water liquefies the butter. A person then rotates the lid upon the top of the inner wall and secures it to the pins at the locks. Corn on the cob is then inserted through the opening in the lid as the flaps deflect down. The cob is then placed and turned into the butter. Once the cob up to the stump has passed the opening, the corn on the cob is withdrawn upwards. In withdrawing the cob, the flaps deflect upwards and retain excess butter beneath the flaps and within the chamber. As the flaps glide upon the cob, the present invention prevents drips and other messes caused by buttered corn on the cob. Made of a flexible material, the flaps and the lid bend readily to ease cleaning by manual means or mechanical devices.

From the aforementioned description, a corn on the cob buttering device has been described. The device is uniquely capable of retaining butter as corn on the cob is withdrawn from a vessel. The corn on the cob buttering device and its various components may be manufactured from many materials, including but not limited to singly or in combination, polymers, polyester, polyethylene, polypropylene, polyvinyl chloride, nylon, ferrous and non-ferrous metals and their alloys, and composites.

I claim:

1. A container for buttering corn on the cob comprising:

a vessel, having an outer wall and an inner wall inside of said outer wall, and said outer wall having a top, an annular space formed between said outer wall and said inner wall;

a lid removably secured upon said vessel having an approximately centered round opening an two or more flaps ending at said opening;

said vessel having a closed bottom and an opposite open top;

said inner wall forming a chamber having a closed bottom and an open top, said top being folded over to overlap with said outer wall, and a generally round shape to receive corn on the cob and butter; and said annular space continuing beneath said chamber and above the bottom of said outer wall, and within the annular space formed between said outer wall and said inner wall provided for introduction of a heated medium to sustain the butter into a liquid stage.

2. The container of claim 1 wherein said chamber is one of cylindrical or conical.

3. The container of claim 1 and further comprising:

said lid having a similar shape to the top of said outer wall, a flat planar shape with an integral band upon the perimeter of said lid perpendicular to said lid, said band overlapping said outer wall and said folded over inner wall top; and, each of said flaps having a leading edge forming a portion of said opening, a bending area opposite said leading edge, and one or more slits spanning from said leading edge to said bending area and separating adjacent flaps.

4. The container of claim 3 further comprising:

said slits being linear in shape.

5. The container of claim 4 further comprising:

said lid having a plurality of flaps surrounding said opening.

6. The container of claim 5 wherein said lid has four flaps.

7. The container of claim 5 wherein said lid has three flaps.

8. The container of claim 3 further comprising:

said inner wall lapping over said outer wall and connecting to said outer wall proximate to said handle; and, said band of said lid lapping over said inner wall and connecting to said outer wall proximate to said handle.

9. The container of claim 8 wherein said inner wall and said band of said lid connect to said outer wall using a bayonet type lock.

10. The container of claim 1 and including a handle pivotally connected to said outer wall proximate to said top.

* * * * *